US006092517A

United States Patent [19]

Schanel

[11] Patent Number: 6,092,517

[45] Date of Patent: Jul. 25, 2000

[54] CONCRETE SURFACE TRIMMING APPARATUS

[76] Inventor: Douglas R. Schanel, 3630 N. Stone Ave., Colorado Springs, Colo. 80907

[21] Appl. No.: 08/734,259

[22] Filed: Oct. 21, 1996

[51] Int. Cl.[7] ..... B28D 1/32

[52] U.S. Cl. ..... 125/23.01; 125/25; 125/38; 451/342; 83/678

[58] Field of Search ..... 125/23.01, 25, 125/38; 451/342, 343, 49, 354, 439; 83/678, 663

[56] References Cited

U.S. PATENT DOCUMENTS

| | | | |
|---|---|---|---|
| 2,326,264 | 8/1943 | Stetler | 451/354 |
| 4,199,905 | 4/1980 | Neidigh et al. | 451/354 |
| 5,240,503 | 8/1993 | Levy et al. | 451/354 |
| 5,403,133 | 4/1995 | Kim | 451/439 |

FOREIGN PATENT DOCUMENTS

| | | | |
|---|---|---|---|
| 402190265 | 7/1990 | Japan | 451/354 |

*Primary Examiner*—Robert A. Rose
*Assistant Examiner*—George Nguyen
*Attorney, Agent, or Firm*—G F. Gallinger

[57] ABSTRACT

An apparatus which is rugged and simple to use, and which can finish shot-crete to an acceptable flatness and finish is disclosed. The efficient mechanical apparatus eliminates the need for skilled hand finishing of concrete or another slurry sprayed on a wall. Labor costs are dramatically reduced to a fraction of generally accepted hand finishing costs. Finished appearance is much improved. The apparatus comprises: a frame; a shearing means which preferably is a revolving drum, to shear the slurry, slidably mounted on a carriage on the frame; carriage motivating and control means for moving the carriage on the frame; and, frame support means for spacing and positioning the frame adjacent to a side of the wall. A preferred aspect of this invention provides for a frame support means which comprises a track mounted on the wall and a tracking member positioned on a top side portion of the frame. When the lower portion of the frame is moved outwardly, the frame may be slid along the wall so that it is positioned to finish another portion of the wall.

14 Claims, 2 Drawing Sheets

CONCRETE SURFACE TRIMMING APPARATUS

FIELD OF INVENTION

This invention relates to the finishing of shot-crete sprayed on building walls. More particularly this invention relates to an efficient mechanical apparatus which eliminates the need for skilled hand finishing of concrete or an other slurry sprayed over wire mesh on an upright surface.

BACKGROUND OF THE INVENTION

The applicant is a contractor involved in the erection of commercial buildings having unfinished walls made from prefabricated insulated panels. This type of prefabricated insulated panel is made by Insteel Corporation. Insulated walls may be substituted for concrete slab walls. These insulated walls are more inexpensively produced, transported, and erected than concrete slab walls. Not only is the material cost of a building having insulated walls substantially lower than that of the popular concrete slab building, but a finished building, having these insulated walls is generally preferred. The problem with these insulated building walls is not that the walls must be shot-created or sprayed with concrete. The problem is that the sprayed wall must be hand finished. Not only is hand finishing a time consuming and expensive process, but additionally, it is a difficult process that requires experience and skill to master. Many general contractors have regretted erecting prefabricated insulated walls after being unable to find a subcontractor who was able to satisfactorily hand finish a shot-creted surface to an acceptable flatness and finish.

In this application spray is defined to include any and all means of coating a wall with a slurry. And wall is defined to include any upright surface.

OBJECTS AND STATEMENT OF INVENTION

It is an object of this invention to disclose an apparatus which can finish shot crete to an acceptable flatness and finish. It is an object of this invention to disclose an apparatus which is rugged and simple to use. An apparatus that will allow a minimally skilled operator to readily produce a flat upright surface. It is yet a further object of this invention to disclose a powered apparatus which can finish shot-crete so efficiently that the labor costs are reduced to a fraction of generally accepteded hand finishing costs. It is yet a further object of this invention to disclose an apparatus which will allow shot-crete surfaces to be finished to a hereto before unavailable degree of ascetic proficiency. It is yet a further object of this invention to disclose an apparatus which can in a single step finish and produce vertical grooves in a shot creted surface. It is a final object of this invention to disclose an apparatus which can broom finish and produce a flat shot creted surface.

One aspect of this invention provides for an apparatus for finishing a solidifying slurry sprayed on a wall comprising: a frame; a shearing means adapted to shear the slurry, slidably mounted on a carriage on the frame; carriage motivating and control means for moving the carriage on the frame; and, frame support means for spacing and positioning the frame adjacent to a side of the wall.

A preferred aspect of this invention provides for an apparatus as above wherein the shearing means is a revolving drum and wherein the frame support means comprises a track mounted on the wall and a tracking member guided by the track.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
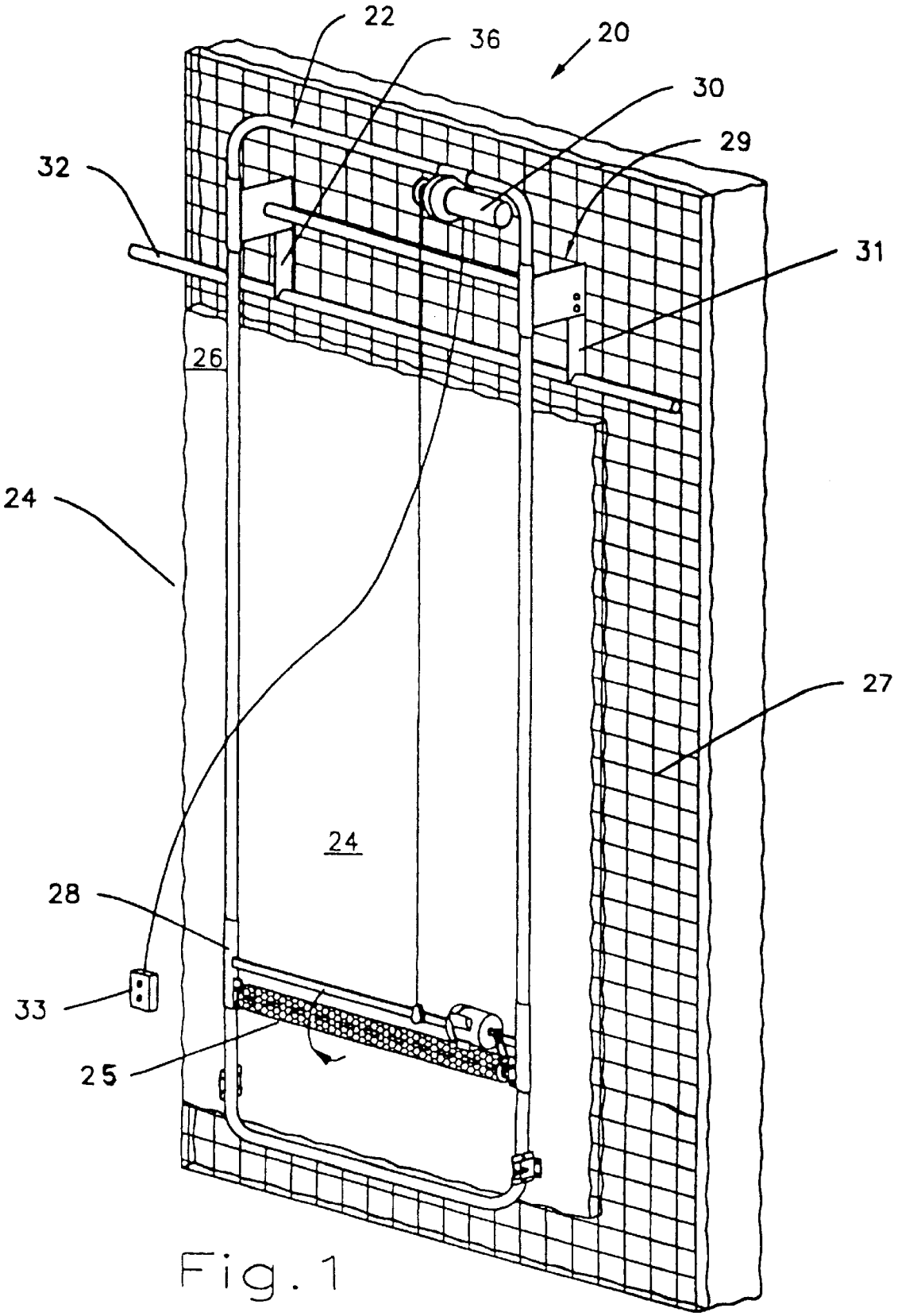
FIG. 1 is a perspective view of a concrete surface trimmer slidably positioned on a track mounted on a side portion of a wall.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a concrete surface trimming apparatus 20 used to finish a solidifying slurry sprayed on a wall 24 covered by a wire mesh 25. The apparatus 20 comprises: a frame 22; a shearing means 25 adapted to shear the slurry 26, which is slidably mounted on a carriage 28 on the frame 22; a carriage motivating and control means which preferably is an electric winch 30 having control 33 for moving the carriage 28 on the frame 22; and, frame support means 29 for spacing and positioning the frame 22 adjacent to a side of the wall 24. Most preferably the frame is fabricated from tubing having a round cross section. Most preferably the frame support means 29 comprises a track which is a pipe 32 mounted on the wall 24 and a tracking member 31 guided by the tracking pipe 32. Most preferably the frame 22 is generally rectangular and the carriage 28 is adapted to slide along and between opposite sides thereof.

Figure 2:
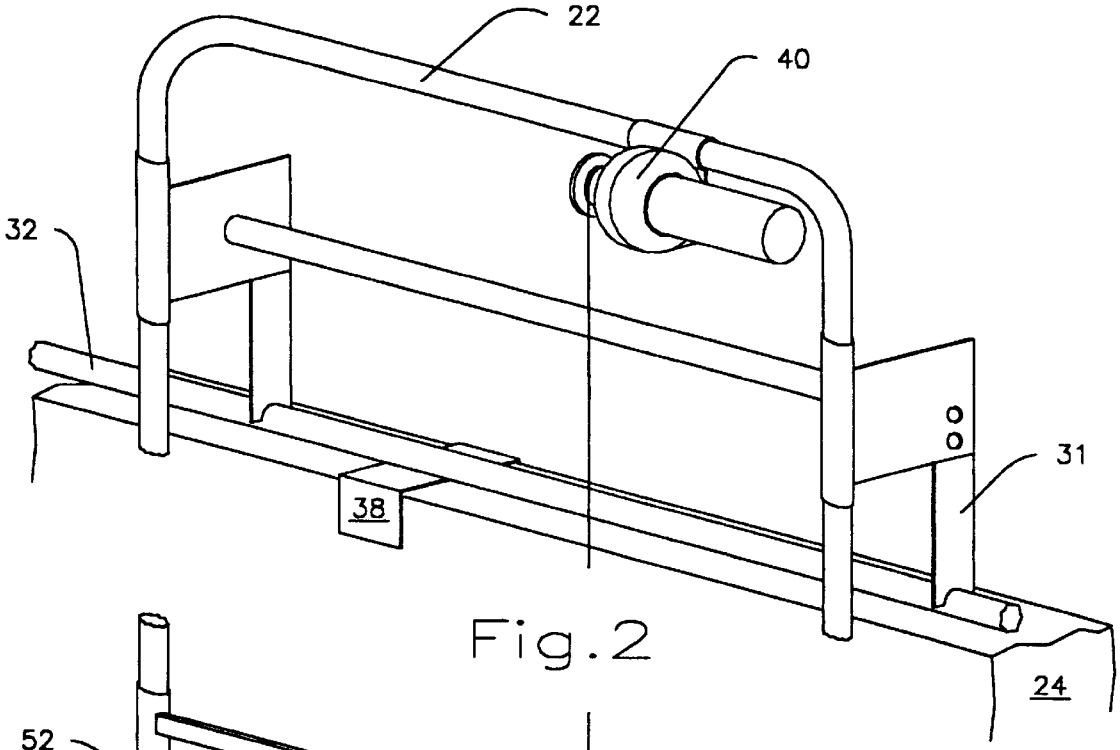
FIG. 2 is an enlarged perspective view of a top end portion of the concrete surface trimming apparatus slidably positioned on a track mounted on a central portion of a wall.

FIG. 2 is an enlarged perspective view of a top end portion of the concrete surface trimming apparatus 20 slidably positioned on a tracking pipe 32 mounted on a top portion of the wall 24. When the tracking pipe 32 is mounted on the top side portion of the wall 24, inverted U shaped brackets 38 which slide downwardly over the wall 24 may be used to support the tracking pipe 32. The carriage motivating and control means which most preferably comprises an electrically powered winch 40 is mounted on a top portion of the frame 22.

Figure 3:
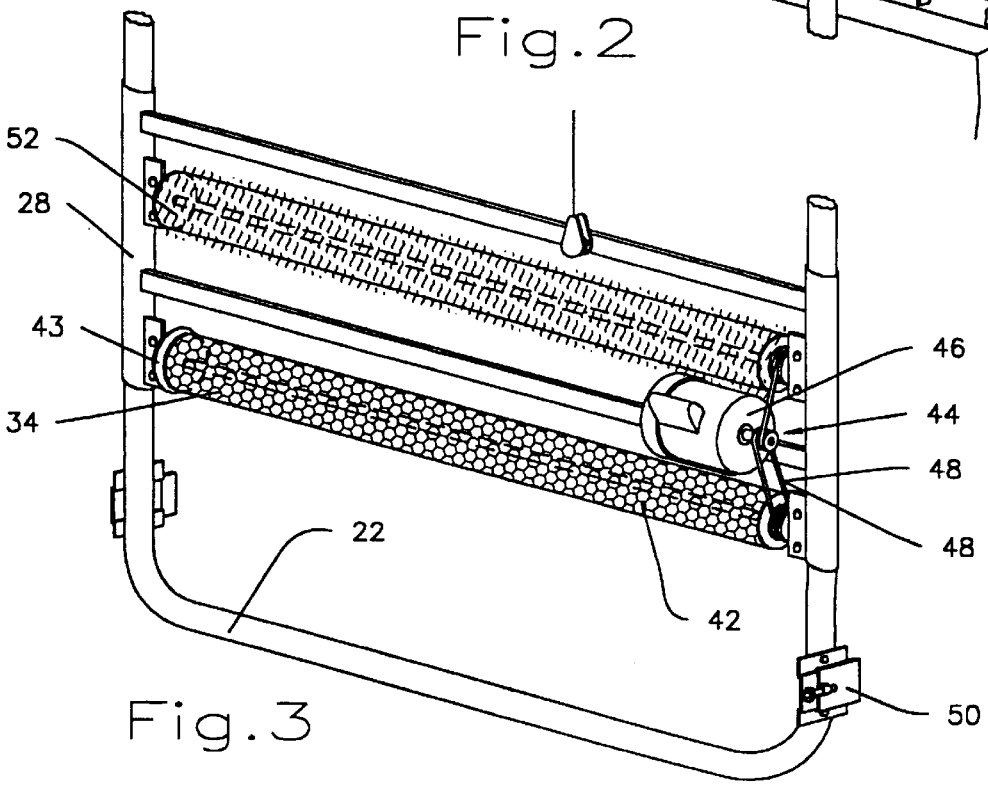
FIG. 3 is an enlarged perspective view of a lower end portion of the concrete surface trimming apparatus showing the drum and drum drive.

FIG. 3 is an enlarged perspective view of a lower end portion of the concrete surface trimming apparatus 20. FIG. 3 best shows the preferred form of the shearing means 25 which is a drum 42 and has a preferred form of blade means, expanded metal 34 around its circumferential side portion. A drive means 44 for revolving the blade means is preferably mounted on the carriage 28 and comprises an electrical motor 46 and a V-belt 48. FIG. 3 also best shows a spacing arm 50 extending from a lower side portion of the frame 22 towards the wall 24 to space the lower side portion of the frame 22 from the wall 24. Most preferably the arm 50 has an adjustable extension so that spacing of the frame 22 from the wall 24 may be therewith adjusted.

FIG. 3 additionally shows two optional features on the concrete surface trimming apparatus 20. A left end portion of the revolving drum 42 has a groove formatation projection 43 used to form a vertical groove in the wall 24. FIG. 3 also shows a broom roller 52 mounted on the carriage 28, driven by electric motor 46, for providing the solidifying slurry 26 which has been trimmed with a broomed or brushed finish.

To use the concrete surface trimming apparatus 20 the tracking pipe 32 must first be mounted along the wall 24. The tracking arm 31 is then seated on the tracking pipe 32. Spacing arms 50 are then adjusted to appropriately space the apparatus 20 from the wall 24. Drum 42 is then powered to begin revolving and the carriage 28 carrying the revolving drum 42 is then moved vertically along the wall 24 using electric winch 30 having control 31 for moving the carriage 28 on the frame 22, so that the slurry 26 is finished in a vertical strip beneath the revolving drum 42. The lower end portion of the frame 22 is then moved away from the wall 24, lifting the drum 42 therefrom. The apparatus is then slid laterally along the wall 24 on tracking pipe 32 generally the width of the drum 42 so that an adjacent strip on the wall 24 may be finished. This procedure is repeated until the entire wall 24 has been finished. The revolving drum 42 shears off the slurry 26 leaving a remarkably flat finished surface in a small fraction of the time which would otherwise be consumed hand finishing the wall 24.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I Claim:

1. An apparatus for finishing a solidifying soft wet slurry sprayed on a wall comprising:

a frame;

a revolving shearing means adapted to tangentially shear the slurry, slidably mounted on a carriage on the frame;

carriage motivating and control means for moving the carriage on the frame; and, frame support and spacing means for spacing and positioning the frame adjacent to a side of the wall so that the shearing means shears off only the outer most rough portion of the slurry sprayed on the wall and leaves a substantial uniformly thick underlying portion of the slurry continuously adhered on the wall having a smooth flat exterior surface.

2. An apparatus as in claim 1 further comprising a drive means for revolving the shearing means.

3. An apparatus as in claim 1 wherein the frame support means comprises a track laterally mounted on the wall and a tracking member guided by the track.

4. An apparatus as in claim 3 wherein the shearing means is generally drum shaped and has a blade means positioned on its circumferential side portion.

5. An apparatus as in claim 4 wherein the frame is generally rectangular and wherein the carriage is adapted to slide along and between opposite sides thereof.

6. An apparatus as in claim 5 wherein the drive means for revolving the shearing means is mounted on the carriage.

7. An apparatus as in claim 6 wherein the drive means for revolving the shearing means comprises an electrical motor and a V-belt.

8. An apparatus as in claim 6 wherein the carriage motivating and control means is mounted on a top portion of the frame.

9. An apparatus as in claim 8 wherein the carriage motivating and control means comprises an electrically powered winch.

10. An apparatus as in claim 9 further comprising a spacing arm extending from a lower side portion of the frame towards the wall to space the lower side portion of the frame from the wall.

11. An apparatus as in claim 10 wherein the arm has an adjustable extension so that spacing of the frame from the wall may be therewith adjusted so that a selected depth of slurry may be left on the wall.

12. An apparatus as in claim 10 wherein the frame is fabricated from tubing.

13. An apparatus as in claim 12 wherein the tubing has a round cross section.

14. An apparatus as in claim 4 wherein the blade means comprises expanded metal.

* * * * *